US009662654B2

(12) United States Patent
Iten et al.

(10) Patent No.: US 9,662,654 B2
(45) Date of Patent: May 30, 2017

(54) SPACER FOR PIPETTE TIP CARRIERS STACKED ONE ON TOP OF ANOTHER

(71) Applicant: TECAN TRADING AG, Mannedorf (CH)

(72) Inventors: Thomas Iten, Zurich (CH); Hanna Rethwisch, Hamburg (DE)

(73) Assignee: TECAN TRADING AG, Mannedorf (CH)

( * ) Notice: Subject to any disclaimer, the term of this patent is extended or adjusted under 35 U.S.C. 154(b) by 0 days.

(21) Appl. No.: 14/567,179

(22) Filed: Dec. 11, 2014

(65) Prior Publication Data

US 2015/0174579 A1 Jun. 25, 2015

(30) Foreign Application Priority Data

Dec. 20, 2013 (CH) ..... 2127/13

(51) Int. Cl.
*B01L 9/00* (2006.01)
*B65D 25/10* (2006.01)

(52) U.S. Cl.
CPC ..... *B01L 9/543* (2013.01); *B65D 25/108* (2013.01); *Y10T 29/49826* (2015.01)

(58) Field of Classification Search
CPC ..... B01L 9/543; B01L 9/52; B01L 2200/021
See application file for complete search history.

(56) References Cited

U.S. PATENT DOCUMENTS

| | | | | |
|---|---|---|---|---|
| 5,366,088 | A * | 11/1994 | Hill et al. | 206/499 |
| 6,098,819 | A * | 8/2000 | Link | 211/85.13 |
| 6,534,015 | B1 * | 3/2003 | Viot et al. | 422/564 |
| 2006/0045815 | A1 | 3/2006 | Hovatter | |
| 2010/0266457 | A1 * | 10/2010 | Rethwisch et al. | 422/104 |
| 2011/0300620 | A1 * | 12/2011 | Belz et al. | 435/287.2 |
| 2013/0336852 | A1 * | 12/2013 | Rethwisch et al. | 422/564 |

FOREIGN PATENT DOCUMENTS

| | | |
|---|---|---|
| DE | 19742493 | 2/1999 |
| DE | 19742493 C1 | 2/1999 |
| EP | 2210668 | 7/2010 |
| EP | 2210668 A2 | 7/2010 |
| EP | 2508261 | 10/2012 |
| EP | 2508261 A1 | 10/2012 |

* cited by examiner

*Primary Examiner* — Brian R Gordon
(74) *Attorney, Agent, or Firm* — Notaro, Michalos & Zaccaria P.C.

(57) ABSTRACT

A frame-shaped, essentially rectangular spacer for pipette tip carriers stacked one on top of another includes a horizontal base surface, a peripheral side wall, which stands essentially perpendicular to the base surface and forms two longitudinal sides and two transverse sides, and an upper surface. Each longitudinal side and transverse side includes an inner side. The upper surface is arranged at an upper end of the side wall and essentially horizontally. The spacer is implemented to form a stabilizing support connection with an essentially rectangular pipette tip carrier positioned on the spacer. In addition, the spacer includes centering spring elements, which are arranged on the inner side of all longitudinal sides and transverse sides, having a springy part spaced apart in relation to the inner side of the respective side wall.

17 Claims, 3 Drawing Sheets

SPACER FOR PIPETTE TIP CARRIERS STACKED ONE ON TOP OF ANOTHER

RELATED PATENT APPLICATIONS

This patent application claims priority of the Swiss patent application No. CH 02127/13 filed on 20 Dec. 2013, the entire disclosure of which is herein incorporated by explicit reference for any purpose.

TECHNICAL FIELD OF THE PRESENT INVENTION

The invention relates to spacers for pipette tip carriers stacked one on top of another. In chemical, biological, pharmaceutical, and similar laboratories, small liquid volumes are typically received and discharged using pipettes. Automated liquid handling platforms are frequently used for this purpose, which enable the simultaneous receiving and/or discharging of liquid volumes with high precision and, nonetheless, high throughput rates. Such liquid handling platforms very often comprise pipetting robots, which are equipped with disposable or single-use pipette tips to avoid contaminations of a sample. Liquid handling platforms are typically charged with such disposable or single-use pipette tips, in that carrier plates equipped with pipette tips or even stacks of such carrier plates are provided. Such carrier plates typically comprise an array of pipette tips, which are arranged so that a pipetting head of a pipetting robot can receive one or more of these pipette tips. Multichannel pipetting heads can comprise one or more rows of pipettes or an array of pipettes. The pipettes of pipetting heads having many channels are preferably arranged or at least can be arranged so that rows or columns of wells of standard microplates can be processed simultaneously; multichannel pipetting heads are also known, using which all wells of a standard microplate can be processed simultaneously.

RELATED PRIOR ART

Normalized standard microplates (cf., for example, norm ANSI_SBS 1-4 2004; American National Standards Institute, 2006) are known and have arrays of wells, which are arranged, for example, at an axial spacing of 9 mm (96-well microplate) or of 4.5 mm (384-well microplate).

Carriers or carrier plates for disposable or single-use pipette tips and stacks of such carrier plates having inserted pipette tips are known from the prior art. Thus, document EP 2 210 668 A2 discloses a carrier (cf. FIGS. 1 and 2) which comprises a frame 1, having four side walls 2, 3, 4, 5, having a lower edge 6, a plate 21 having a plurality of holes 23 for the insertion of pipette tips 36, and means for the detachable connection of frame 1 and plate 21. These means for the detachable connection of frame 1 and plate 21 have contact surfaces 8, 32 on the upper edge 7 of the frame 1 and on the lower side 24 of the plate 21. When the plate 21 is placed on the frame 1, these contact surfaces 8, 32 touch each other, wherein guide elements 9, 33, which are arranged on the frame 1 and plate 21 transversely to the contact surfaces 8, 32, engage in one another with lateral play. Spacers 47 for plates 21 stacked one on top of another having disposable pipette tips 36 are also known from this document. These spacers 47 have four vertical side walls 48, 49, 50, 51, which are connected to one another at the corners, and an intermediate floor 52 having a plurality of further holes 53, which are arranged corresponding to the array of a standard microplate and the matrix arrangement of the holes 23 of the plate 21. Such a spacer 47, which is preferably produced in one piece from plastic, is placed having its lower edge 54 outside the holes 23 on the upper side of a plate 21. This plate 21 can be placed on a frame 1 or on a further spacer 47. A further plate 21 can be placed with its lower side on the upper edge 55 of the spacer 47 outside the holes 23 and a lid 38 (not shown here) or an additional spacer 47 can be placed above this. Using multiple such plates 21 or pipette tip carriers, a very large number of pipette tips can be stored in a space-saving manner, that is in a so-called "interlocking" or "nested" manner, because the ends of the pipette tips held in one pipette tip carrier each engage in the pipette tips arranged underneath in the stack. When the upper plate 21 is lifted off, the intermediate floor 52 prevents pipette tips 36 from a plate 21 arranged underneath from also being removed. All individual parts of such a pipette tip package can simply be stacked one on top of another and lifted off of one another, for example, by a robot or by hand. After the use of the pipette tips 36 of the uppermost pipette tip carrier 21, the latter and the spacer 47 located underneath are lifted off; the pipette tips 36 of the second highest pipette tip carrier 21 can then be used, etc.

Another stackable pipette tip carrier essentially implemented as a rectangular plate is known from the document EP 2 508 261 A1. Such a pipette tip carrier has a first array of 8×12 through holes, for example, each of which is used to hold a pipette tip on its shaft. In addition, such a pipette tip carrier has a second array, also of 8×12 through holes, each of which lets through a front end of a pipette tip. These two orthogonal arrays having equal lattice constant are arranged offset in relation to one another, wherein this offset is half of the lattice constant in both directions of the lattice. Using multiple such pipette tip carriers, which are each arranged turned by 180° in relation to one another, a very large number of pipette tips can be stored in a space-saving manner, that is in a so-called "interleaved" or "offset" manner, because the ends of the pipette tips held in one pipette tip carrier each penetrate the pipette tip carrier arranged underneath in the stack adjacent to the pipette tips held therein. These pipette tip carriers typically comprise two upwardly oriented handles, which are arranged on the two transverse sides of the plate, and which provide a grasping point for transporting the pipette tip carrier without the pipette tips having to be touched for this transport. These handles are connected to the pipette tip carrier via a jointed tab and comprise a snap tab, using which the pipette tip carrier can be removably fastened in a stack with a storage container. The lowermost pipette tip carrier is always fixed using its snap tabs on the container; after the use of all pipette tips, the empty pipette tip carrier is separated from the container and replaced by the next, lowermost pipette tip carrier of the stack.

A further stackable pipette tip carrier is known from the document US 2006/0045815 A1, which is essentially implemented as a rectangular plate having holes for holding pipette tips and comprises a peripheral cover and a closure mechanism. A corresponding package comprises a pipette tip carrier, a base for supporting the pipette tip carrier, and a closure mechanism on the pipette tip carrier, which is implemented for the external engagement on a side wall of the base; this side wall of the base carries the pipette tip carrier. Such a package can also comprise a removable lid for the pipette tip carrier, wherein this lid can also have a closure mechanism, which is implemented for the external engagement on the cover of the pipette tip carrier or on a side wall of the base. The entirety of base, peripheral cover of the pipette tip carrier, and lid results in a protective package for the pipette tips, which are located in one or more (stacked) pipette tip carriers. In this case, the springy enclosure mechanisms are oriented downward and are accessible at any time from the outside without lifting off the lid. Using multiple such pipette tip carriers, a very large number of pipette tips can be stored in a space-saving manner, that is in a so-called "interlocking" or "nested" manner, because the ends of the pipette tips held in one pipette tip carrier each engage into the pipette tips arranged underneath in the stack.

The document DE 197 42 493 C1 can be considered to be the closest prior art. It describes a magazine for pipette tips having multiple stacking frames stacked one on top of another and holding plates, which are inserted from above at approximately half height in the stacking frame on brackets, having receptacles for the pipette tips. These magazines have a space-saving stacked arrangement having interlocking pipette tip layers. Secure stacking one on top of another is enabled by corresponding structural elements. The essential elements are springy tabs having hooks or locking ribs on the opposing long inner sides of the side walls of the stacking frame and on the short sides of the holding plates, and also corresponding assigned locking elements. The friction-locked and/or formfitting connection (locking) of the uppermost stacking frame to the next lower stacking frame is disengaged by removing the uppermost holding plate (after the processing of the uppermost layer of pipette tips), so that subsequently the uppermost stacking frame can also be lifted off and the next pipette tip layer can be exposed.

OBJECT AND SUMMARY OF THE PRESENT INVENTION

It is the object of the present invention to propose an alternative spacer for pipette tip carriers stacked one on top of another, which causes improved centering and stabilization of the carrier stack, without all elements of such a carrier stack having to be locked with one another.

This object is achieved with a spacer having the features of independent claim 1. Such a frame-shaped, essentially rectangular spacer for pipette tip carriers stacked one on top of another comprises a horizontal base surface, a peripheral side wall, which stands essentially perpendicular to the base surface and forms two longitudinal sides and two transverse sides, and an upper surface, wherein each longitudinal side and each transverse side comprises an inner side. Such a spacer according to the invention is characterized in that the upper surface is arranged on an upper end of the side wall and extending essentially horizontally, wherein the spacer is implemented to form a stabilizing support connection to an essentially rectangular pipette tip carrier, which is positioned on the spacer, and it comprises centering spring elements, which are arranged on the inner side of all longitudinal sides and transverse sides, having a springy part spaced apart in relation to the inner side of the respective side wall part, wherein these centering spring elements act upon a pipette tip carrier, on which the spacer lies with horizontal play, and thus act as a centering aid or as a twist lock in the stack.

Such a spacer preferably has a central, essentially rectangular opening, which can be penetrated by a first part of a pipette tip carrier, which is positioned on the spacer and comprises a flange. In such cases, it is especially preferable for the spacer to comprise connecting elements (for example, holding pins) in the region of its upper surface, which are implemented to form a detachable support connection with the flange of this pipette tip carrier.

Alternatively, it can be provided that a spacer is inseparably connected in the region of its upper surface to the flange of an essentially rectangular pipette tip carrier, which is positioned on the spacer, or that a pipette tip carrier/spacer combination is produced in one piece.

Advantages of the spacer according to the invention comprise the following:

- Pipette tip carriers and spacers located directly above them are not locked to one another in the stack; parts of this stack can thus be lifted off easily from the remainder of the stack (manually or robotically).
- In such a stack, in each case one pipette tip carrier and the spacer arranged above it are connected to one another via a stabilizing support connection or are even produced in one piece and therefore always represent a structural stack unit. One or more such structural stack units is/are always lifted off as a whole from the stack.
- The two parts of such a structural stack unit are preferably held together via holding pins of a spacer, wherein these holding pins preferably engage in the friction lock in the centering holes of a pipette tip carrier positioned above this spacer. Pipette tip carriers known per se can thus be used.
- The spring force which the centering spring elements of a spacer exert on the pipette tip carrier arranged underneath is so small that the pipette tip carrier to which these centering spring elements act upon remains at rest when the structural stack unit arranged above it is lifted off and is not unintentionally lifted off.
- The vertical friction fit from an upper structural unit to that underneath acts from a first part of the upper pipette tip carrier via collars of the pipette tips inserted into the lower pipette tip carrier on a second part of the lower pipette tip carrier; no further forces except for its intrinsic weight thus act on the interposed spacer. The centering spring elements of the spacer therefore function exclusively as additional centering aids or as a twist barrier in the stack, but they have no supporting function.

BRIEF INTRODUCTION OF THE DRAWINGS

The spacer according to the invention will be explained in greater detail on the basis of schematic drawings, which illustrate exemplary embodiments and do not restrict the scope of the present invention. In the figures.

DETAILED DESCRIPTION OF THE PRESENT INVENTION

Figure 1:
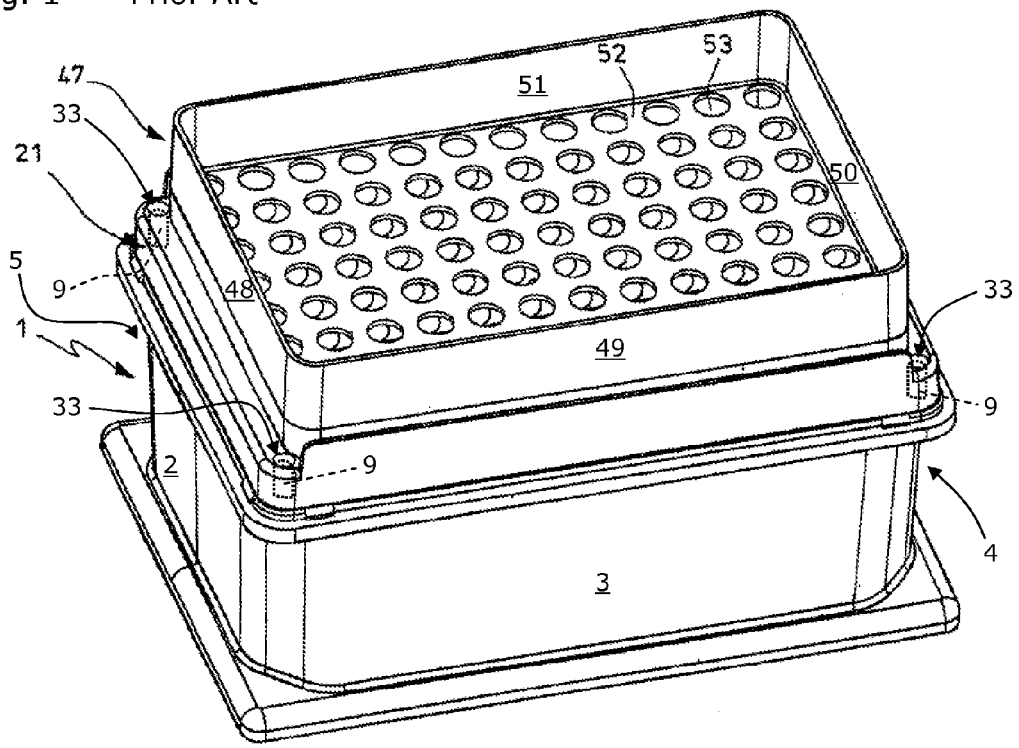
Fig. 1 Prior Art
FIG. 1 shows a 3-D view of a pipette tip carrier, which is known from the document EP 2 210 668 A2 and is referred to as a plate, which rests on a base referred to as a frame and on which a spacer is placed.
Figure 2:
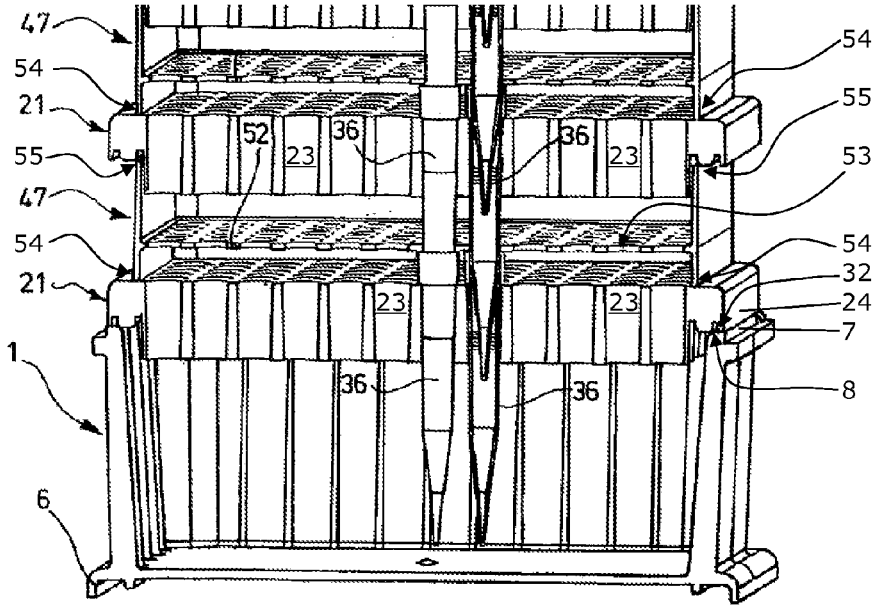
Fig. 2 Prior Art
FIG. 2 shows a vertical longitudinal section through a stack corresponding to FIG. 1 and known from the document EP 2 210 668 A2, having at least three pipette tip carriers spaced apart from one another by a spacer, wherein the lowermost pipette tip carrier lies on the base.
Figure 3:
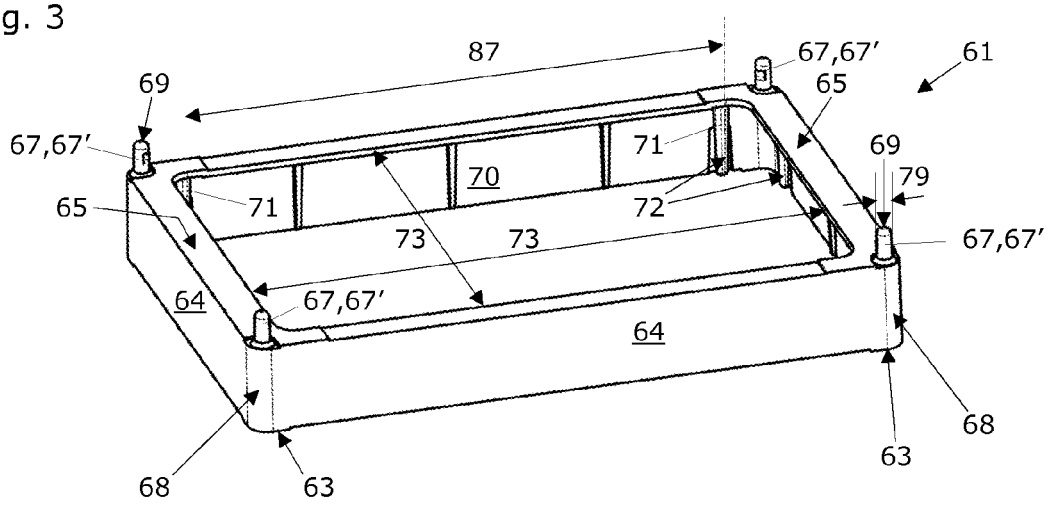
FIG. 3 shows a first embodiment of a spacer according to the invention, having four holding pins for achieving a support connection with a pipette tip carrier positioned on the spacer, which additionally comprises centering spring elements, which are arranged on its inner sides and function as a centering aid or twist barrier in relation to a pipette tip carrier positioned below the spacer.

Preferred exemplary embodiments of the spacer according to the invention will now be described in detail. In this case, FIG. 3 shows a first embodiment of a spacer according to the invention. This spacer 61 is designed as frame-shaped and essentially rectangular and is used for centering and stabilizing pipette tip carriers 62 stacked one on top of another.

The spacer 61 comprises a horizontal base surface 63, a peripheral side wall 64 standing essentially perpendicular to the base surface 63, and an upper surface 65. In the exemplary embodiment shown, a base surface 63, which is set back somewhat in relation to the remaining lower edge of the spacer 61, is located in each corner of the spacer 61. Alternatively, a single peripheral base surface 63 can also be provided; however, the embodiment of this base surface 63 only plays a subordinate role, because in the stack, only the intrinsic weight of the spacer 61 is transmitted via this base surface 63 onto the pipette tip carrier 62 positioned underneath (cf. FIG. 5).

The upper surface 65 of the spacer 61 is arranged on an upper end of the side wall 64 and extending essentially horizontally. In the exemplary embodiment shown, an upper surface 65, which connects two of the corners 68 of the spacer 61 to one another, and which is set back somewhat in relation to the remaining upper edge of the spacer 61, is located on both transverse sides of the spacer 61. Alternatively, a single peripheral upper surface 65 can also be provided; however, the embodiment of this upper surface 65 plays a subordinate role, since no forces are transmitted on this upper surface 65 in the stack (cf. FIG. 5).

The spacer 61 according to the invention is implemented to form a stabilizing support connection with an essentially rectangular pipette tip carrier 62 positioned on the spacer 61. This support connection is implemented as either separable or inseparable; in any case, it provides a play-free connection between the spacer 61 and the pipette tip carriers 62 positioned immediately above it. In addition, this connection is so stable that when a pipette tip carrier 62 is lifted off of a stack, the spacer 61 according to the invention, which is arranged directly below this pipette tip carrier 62, is lifted off together with the pipette tip carrier 62 from the stack in each case. A spacer 61 according to the invention and the pipette tip carrier 62 positioned directly thereon are therefore always connected to one another via a stabilizing support connection and represent a structural stack unit according to the invention.

As a further element, which is essential to the present invention, the spacer 61 comprises centering spring elements 71, arranged on an inner side 70 of the side wall 64, having a springy part 72 spaced apart in relation to the inner side 70 of the respective side wall 64. The springy parts 72 of the centering spring element 71 of the spacer 61 are preferably arranged on the inner side 70 of the side wall 64 and implemented such that they act upon a second part 80 of an essentially rectangular pipette tip carrier 62, on which the spacer 61 rests with horizontal play, and thus minimize the horizontal play between the underlying pipette tip carrier 62 and the spacer 61 lying thereon (cf. FIG. 6). It is particularly preferable for the springy parts 72 of the centering spring elements 71 to be implemented extending essentially vertically or horizontally. The springy parts 72 of the centering spring elements 71 are especially preferably implemented extending essentially vertically (as shown in FIGS. 3 to 7), because in particular the injection molding and subsequent demolding of the spacers 61 is made easier by this arrangement.

The centering spring elements 71 shown are arranged at a defined spacing 87 to one another. This spacing 87 is preferably selected, both in relation to the longitudinal sides and also in relation to the transverse sides of the spacers 61, so that the greatest possible distance results between two centering spring elements 71 arranged on the same longitudinal side or transverse side. This arrangement ensures a maximum centering effect or twist barrier in the stack of pipette tip carriers 62.

An inclined or essentially horizontal arrangement of the springy parts 72 of the centering spring elements 71 would have the advantage that the springy parts 72 of the centering spring element 71 could be implemented longer and could be more easily influenced in their spring action; however, the injection molding and subsequent demolding can prove to be more difficult.

Polypropylene is preferred as the material for the production of the spacers 61. However, other plastics capable of injection molding, or plastic blends or composites, can also be used for producing the spacers 61 if needed. Admixed colorants make it easier to recognize the spacers 61, whether during use in a stack or when they are stored as individual parts.

Greatly varying stabilizing support connections are fundamentally conceivable in such a structural stack unit:

1. This support connection is reversible, i.e., it can be established and detached again as needed. This has the advantage that pipette tip carriers known from the prior art can be used. Such known pipette tip carriers 62 comprise, for example, a first part 74 and a flange 75 arranged above it (cf. FIG. 4). To receive such a pipette tip carrier 62, the spacer 61 comprises a central, essentially rectangular opening 73, which can be penetrated by the first part 74 of a pipette tip carrier 62, which is positioned on the spacer 61 and comprises a flange 75 (cf. FIG. 4). In such cases, the spacer 61 preferably comprises connecting elements 67 in the region of its upper surface 65, which are implemented to form a detachable support connection with the flange 75 of this pipette tip carrier 62. Typically, the flange 75 of such a pipette tip carrier 62 known from the prior art comprises four centering holes 78, which are each arranged in one corner and have a defined cross section 77.

According to the preferred first embodiment shown in FIG. 3, the spacer 61 according to the invention comprises four connecting elements 67, which are implemented as holding pins 67', are each arranged in one corner 68 of the upper surface 65, and are implemented as bodies standing approximately vertically in relation to the upper surface 65. In this case, the holding pins 67' of the spacer 61 have an effective cross section 79 which is adapted to the defined cross section 77 of the centering holes 78 so that each holding pin 67' of the spacer 61 is implemented fixedly seated using friction fit in one of these centering holes 78.

Alternative spacers 61 comprise other connecting elements 67, for example, catch hooks, snap hooks, and/or eyes for such connecting elements (not shown).

2. This support connection is irreversible, i.e., it is established and cannot be detached again. This also has the advantage that pipette tip carriers known from the prior art can be used. Such known pipette tip carriers 62 comprise, for example, a first part 74 and a flange 75 arranged above it (cf. FIG. 4). To receive such a pipette tip carrier 62, the spacer 61 comprises a central, essentially rectangular opening 73, which can be penetrated by the first part 74 of a pipette tip carrier 62, which is positioned on the spacer 61 and comprises a flange 75 (cf. FIG. 4). According to the alternative embodiment shown in FIG. 7, the spacer 61 according to the invention is inseparably connected in the region of its upper surface 65 to the flange 75 of an essentially rectangular pipette tip carrier 62, which is positioned on the spacer 61. This connection can be established by gluing or welding, for example.
3. This support connection is irreversible, i.e., it is established in that a spacer 61 and the pipette tip carrier 62 positioned above it are injection molded in one work step, i.e., in one piece (not shown, but appears similarly as in FIG. 7). Of course, such a connection also cannot be detached again. This has the disadvantage that pipette tip carriers known from the prior art cannot be used. On the other hand, this solution offers the advantage that the two elements of a structural stack unit do not have to be joined together or connected to one another in a separate work step.

If one selects the first embodiment of the spacer 61 according to the invention having four connecting elements 67 implemented as holding pins 67', it is thus particularly preferable for each holding pin 67' of the spacer 61 to comprise at least one element 81, which defines the effective cross section 79 of the holding pins 67'. This defining element 81 is preferably selected from a group of elements which define a round, elliptical, oval, polygonal, or star-shaped cross section. Effective cross sections 79 having arbitrary combinations of these shapes are also conceivable. It is particularly preferable for each holding pins 67' of the spacer 61 to comprise a thickening 83, which, alone or together with further defining elements 81, defines the effective cross section 79 of the holding pins 67'. In addition, it is especially preferable for the element 81, which defines the effective cross section 79 of the holding pin 67', or the thickening 83 of the holding pin 67', to comprise a springy part. For the purpose of the automatic centering of holding pin 67' and centering holes 78 during the joining together of a spacer 61 with the pipette tip carrier 62 positioned thereon, it is preferable for each holding pin 67' to taper at its upper end 69 with increasing height.

Figure 4:
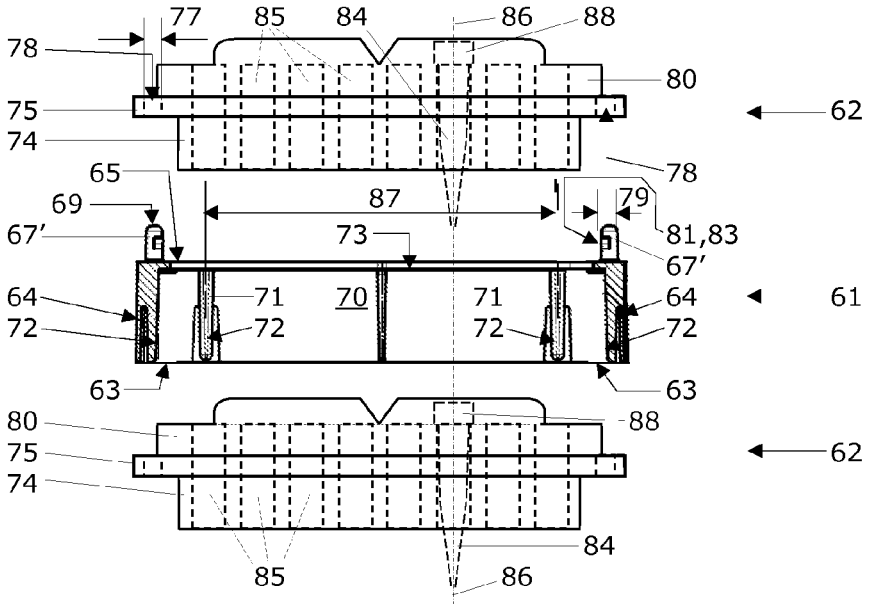
FIG. 4 shows a vertical cross section of the spacer of FIG. 3 together with a pipette tip carrier to be arranged above it and below it, which is known per se.

FIG. 4 shows a vertical cross section of the spacer 61 from FIG. 3 together with a pipette tip carrier 62 known per se, which is to be arranged above and below the spacer. An inner side 70 of the frame-shaped spacer 61 having two centering elements 71 situated thereon at a spacing 87 is well recognizable. The section shown extends here through two opposing centering spring elements 71, which are arranged on the two longitudinal sides, and the springy parts 72 of which are identified. These springy parts 72 are spaced apart in relation to the inner side 70 of the respective side wall 64 and additionally protrude beyond these inner sides 70 (cf. also FIG. 3). Two of the base surfaces 63 and two of the holding pins 67' of the spacer 61 are also visible. These two holding pins 67' taper toward their upper end 69. Both holding pins 67' comprise a thickening 83 as the element 81 which defines the cross section of the holding pin 67'. This thickening defines the friction fit with the holding pins 67' in corresponding centering holes 78 in the flange of the upper pipette tip carrier 62. The spacer 61 comprises a central opening 73 in the upper surface 65, through which a first part 74 of the upper pipette tip carrier 62 is insertable.

The upper pipette tip carrier 62 comprises a first part 74 arranged below the flange 75 and a second part 80 arranged above the flange 75. These three elements of the pipette tip carrier 62 comprise holding holes 85, which all three elements completely penetrate in the vertical direction. Each of these holding holes 85 is implemented to receive a pipette tip 84, wherein each pipette tip 84 stops with its collar 88 on the upper side of the second part 80 and therefore cannot fall through the holding hole 85. The axis 86 of each pipette tip 84 received in the holding hole 85 is aligned vertically. These axes 86 are preferably arranged in an orthogonal array, which corresponds to the array of the wells of a standard microplate (cf. norm ANSI_SBS 1-4 2004). The flange 75 of this pipette tip carrier 62 comprises four centering holes 78, two of which are shown here. All of these centering holes 78 have a defined cross section 77, to which the effective cross section 79 of the holding pins 67' of the spacer 61 is adapted.

The lower pipette tip carrier 62 comprises precisely the same elements as the upper pipette tip carrier 62 just described. The pipette tip carriers 62 shown here, which are known from the prior art, are implemented to receive 96 pipette tips 84 in an 8×12 array.

Figure 5:
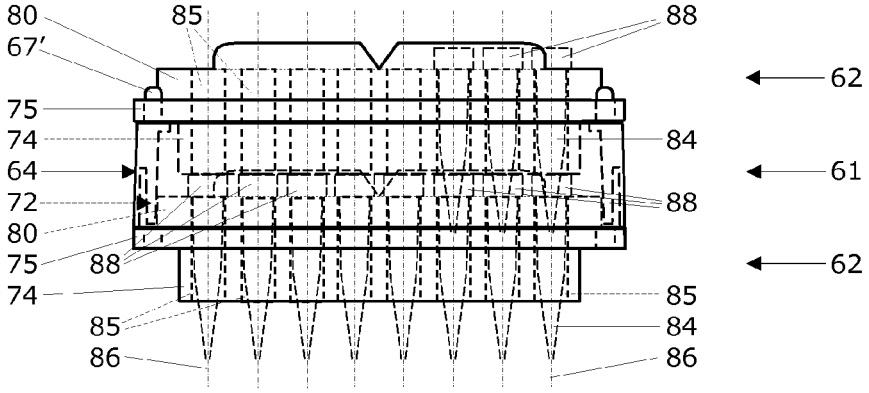
FIG. 5 shows a side view of a stack formed from the elements shown in FIG. 4 in its compact form.

FIG. 5 shows a side view of a stack formed from elements shown in FIG. 4 in its compact form. The upper pipette tip carrier 62 still contains at least three pipette tips 84, while the lower pipette tip carrier 62 is still equipped with 96 pipette tips 84. All elements of this stack were already described in conjunction with FIG. 4. It is essential here that the first part 74 of the upper pipette tip carrier 62 rests on the collars 88 of the pipette tips 84 located in the lower pipette tip carrier 62; the height of the spacer 61 is therefore preferably selected so that the flange 75 of the upper pipette tip carrier 62 just does not rest on the upper surface 65 of the spacer 61. The pipette tips 84 of the upper pipette tip carrier 62 engage in a space-saving manner in the pipette tips 84 of the lower pipette tip carrier 62. The pipette tips 84 in this stack are therefore stored in an "interlocking" or "nested" manner, without the pipette tips touching each other. The axis 86 of each pipette tip 84 received in the holding hole 85 is vertically aligned. These axes 86 are preferably arranged in an orthogonal array which corresponds to the array of the wells of a standard microplate (cf. norm ANSI_SBS 1-4 2004).

Figure 6:
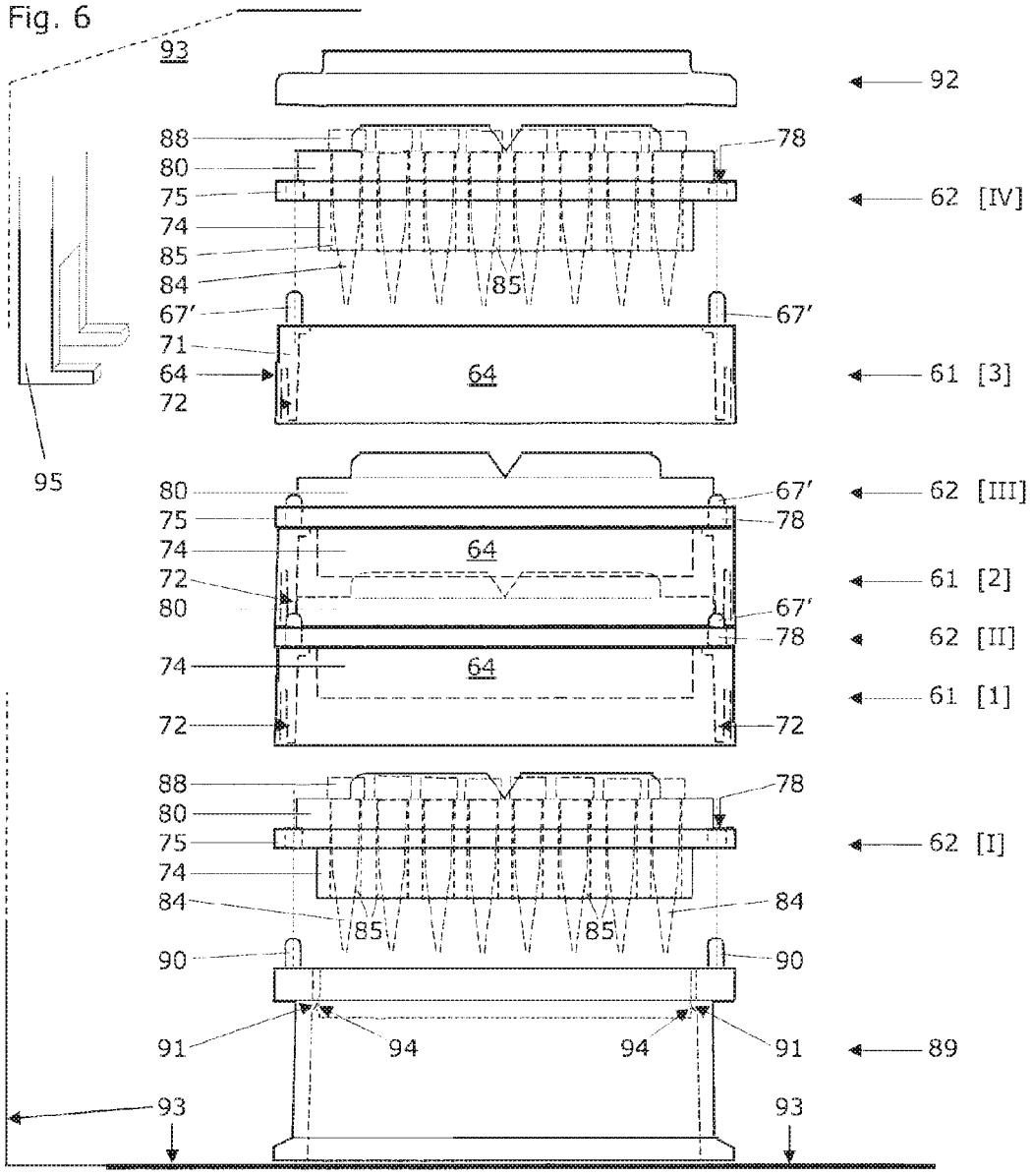
FIG. 6 shows a side view of a complete stack, which comprises a base, four pipette tip carriers equipped with disposable pipette tips, three spacers, and a lid.

FIG. 6 shows a side view of a complete stack, which comprises a base 89, four pipette tip carriers 62 equipped with disposable pipette tips 84, three spacers 61, and a lid 92. For better comprehensibility, the pipette tip carriers are additionally progressively numbered with Roman numerals and the spacers with Arabic numerals here in square brackets.

All pipette tip carriers 62 are originally equipped with 96 pipette tips 84. 96 of these pipette tips 84 are always to be offered for usage step-by-step from top to bottom by the pipette tip carriers 62. The structure of such a stack is to be briefly explained:

At the very bottom, a base 89 having a horizontal base surface is used. This base surface essentially corresponds to the footprint of a standard microplate, therefore the base 89 alone, the base 89 together with stack parts, individual stack parts, or also the entire stack can be grasped and transported using a corresponding microplate handling robot. The base 89 has four centering pins 90. These centering pins 90 are dimensioned so that they engage with play in the centering holes 78 of the flange 75 of the first pipette tip carrier 62. The base 89 preferably has four protrusions 91 on its inner side, which hold the first part 74 of the first pipette tip carrier 62 (indicated by dashed lines here) between them in a friction fit. Each pipette tip carrier 62 preferably has catches 94 at four corresponding points of its first part 74, in which the protrusions 91 engage, so that the friction fit is further reinforced. The first pipette tip carrier 62 thus lies without lateral play on the base 89 and is held by the base. As a consequence, the first pipette tip carrier 62 and the base 89 form a first structural stack unit. Notwithstanding this illustration, the first pipette tip carrier 62 can be inseparably connected to the base 89 (for example, by gluing, welding, or one-piece production). However, it is preferable to use a first pipette tip carrier 62 known from the prior art, so that this stabilizing support connection is preferably established by friction fit, gluing, or welding. The described friction fit, which has already proven itself many times, is particularly preferable.

The completely equipped first pipette tip carrier 62 is laid on the base so that its first part sinks into the base 89 and its flange 75 lies on the upper surface of the base 89.

A first spacer 61 is laid on this first pipette tip carrier 62.

This first pipette tip carrier 61 is initially still separated from the pipette tip carrier 62 to be laid thereon. A second pipette tip carrier 62 is then laid on the first spacer 61, so that it's holding pins 67' are held in the friction fit in the corresponding centering holes 78 in the flange 75 of the second pipette tip carrier 62. The second pipette tip carrier 62 and the first spacer 61 thus together form a structural stack unit.

Alternatively, in each case before being laid on the stack, a pipette tip carrier 62 can be connected to a spacer 61 arranged underneath, in that its holding pins 67' are held in the friction fit in the corresponding centering holes 78 in the flange 75 of the pipette tip carrier 62.

As a further alternative, it can be provided that before being laid on the stack, in each case a pipette tip carrier 62 is connected to a spacer 61 arranged underneath by gluing or welding.

In each case, it is preferable for a pipette tip carrier 62 and a spacer 61 arranged underneath to form a structural stack unit together (already before or only after being laid on the stack), which can later be lifted off in one piece from the stack.

A second spacer 61 is laid on this second pipette tip carrier 62. This second spacer 61 is initially still separated from the pipette tip carrier 62 to be laid thereon. A third pipette tip carrier 62 is then laid on the second spacer 61, so that its holding pins 67 are held in the friction fit in the corresponding centering holes 78 in the flange 75 of the third pipette tip carrier 62. The third pipette tip carrier 62 and the second spacer 61 thus together form a structural stack unit.

FIG. 6 shows the first spacer 61 [1], the second pipette tip carrier 62 (II), the second spacer 61 [2], and the third pipette tip carrier 62 [III] as a packet. It can be seen particularly well here how the springy parts 72 of the centering spring elements 71 of the second spacer 61 [2] act upon the second part 80 of the second pipette tip carrier 62 [II], on which the second spacer 61 lies with horizontal play, and therefore minimize the horizontal play between the second pipette tip carrier 62 [II] and the second spacer 61 [2] lying thereon.

A third spacer 61 is laid on this third pipette tip carrier 62. This third spacer 61 is initially still separated from the pipette tip carrier 62 to be laid thereon. A fourth pipette tip carrier 62 is then laid on the third spacer 61, so that its holding pins 67' are held in the friction fit in the corresponding centering holes 78 in the flange 75 of the fourth pipette tip carrier 62. The fourth pipette tip carrier 62 and the third spacer 61 thus together form a structural stack unit.

A lid 92 is preferably laid on the very top of a stack.

Figure 7:
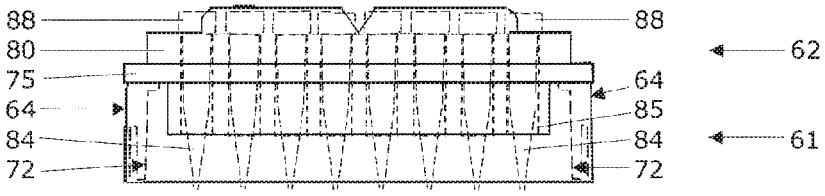
FIG. 7 shows an alternative embodiment of a spacer according to the invention, which is inseparably connected in the region of its upper surface to an essentially rectangular pipette tip carrier positioned on the spacer.

FIG. 7 shows an alternative embodiment of a spacer 61 according to the invention, which is inseparably connected in the region of its upper surface 65 to an essentially rectangular pipette tip carrier 62, which is positioned on the spacer 61. Equipping the spacer 61 with connecting elements 67 (such as holding pins 67' and the like) was omitted here, because a spacer 61 according to the invention and a pipette tip carrier 62 known from the prior art were connected to one another by means of welding. If this spacer 61/pipette tip carrier 62 combination had been produced in one piece in injection molding (not shown), connecting elements 67, but also all parts extending in the horizontal direction (cf. FIG. 4) of the spacer 61 could also have been omitted.

Uses according to the invention of these spacers 61 comprise the stacking of pipette tip carriers 62, which are spaced apart by means of spacers 61 and are preferably equipped with pipette tips 84. The use of a spacer 61 according to the invention, in which a pipette tip carrier 62 is placed with its flange 75 on the upper surface 65 of the spacer 61, whereby the holding pins 67' of the spacer 61 are fixed with friction fit in the centering holes 78 of the pipette tip carrier 62, is especially preferred. Furthermore, a use of a spacer 61 according to the invention is preferred, in which the spacer 61 is laid with its base surface 63 on the flange 75 of a pipette tip carrier 62, wherein the springy parts 72 of the centering spring elements 71 of the spacer 61 act upon the second part 80 of an essentially rectangular pipette tip carrier 62, on which the spacer 61 lies with horizontal play, and therefore minimize the horizontal play between the underlying pipette tip carrier 62 and the spacer 61 lying thereon. In addition, a use of a spacer 61 according to the invention is preferred, in which a pipette tip carrier 62 is lifted off together with the spacer 61 fixed thereon from an underlying pipette tip carrier 62; this lifting off can be performed manually, but also using a corresponding robot of a liquid handling workstation 93.

All corresponding parts of the spacer 61 according to the invention and the pipette tip carrier 62 known from the prior art were identically numbered and identified, even if these parts were not described in detail in each case.

List of reference signs:

Prior art (cf. EP 2 210 668):

| | |
|---|---|
| 1 | frame |
| 2, 3, 4, 5 | side walls |
| 6 | lower edge of 1 |
| 7 | upper edge of 1 |
| 8 | contact surface of 1 |
| 9 | guide element of 1 |
| 21 | plate |
| 23 | holes of 21 |
| 24 | lower side of 21 |
| 32 | contact surface of 21 |
| 33 | guide element of 21 |
| 36 | pipette tip |
| 38 | lid |
| 47 | spacer |
| 48, 49, 50, 51 | side walls of 47 |
| 52 | intermediate floor |

-continued

| List of reference signs: | |
|---|---|
| 53 | further holes of 52 |
| 54 | lower edge of 47 |
| 55 | upper edge of 47 |
| Invention: | |
| 61 | spacer |
| 62 | pipette tip carrier |
| 63 | base surface of 61 |
| 64 | side wall of 61 |
| 65 | upper surface of 61 |
| 67 | connecting element |
| 67' | holding pin |
| 68 | corner of 61 |
| 69 | upper end of 67 |
| 70 | inner side of 64 |
| 71 | centering spring elements of 61 |
| 72 | springy part of 71 |
| 73 | central opening of 61 |
| 74 | first part of 62 |
| 75 | flange of 62 |
| 77 | defined cross section of 78 |
| 78 | centering holes of 62 |
| 79 | effective cross section of 67 |
| 80 | second part of 62 |
| 81 | defining element of 67 |
| 83 | thickening |
| 84 | pipette tip |
| 85 | holding hole |
| 86 | axis of 84 |
| 87 | spacing of 71 |
| 88 | collar of 84 |
| 89 | base |
| 90 | centering pin |
| 91 | protrusions |
| 92 | lid |
| 93 | liquid handling workstation |
| 94 | catch |
| 95 | robot |

What is claimed is:

1. A spacer having an essentially rectangular cross-section (61) for spacing apart pipette tip carriers (62) having an essentially rectangular cross-section in a stack, the spacer (61) comprising:

a lower base surface (63) configured for positioning the spacer onto a pipette tip carrier (62);

a peripheral side wall (64), which stands essentially perpendicular to the lower base surface (63) and forms a frame including two longitudinal sides and two transverse sides, wherein each longitudinal side and transverse side comprises an inner side (70), an upper surface (65), onto which a pipette tip carrier (62) is positionable, and a central, essentially rectangular opening (73) in the upper surface (65) configured for receiving a part of a pipette tip carrier (62), wherein the upper surface (65) is arranged on an upper end of the peripheral side wall (64) and extends essentially horizontally, wherein the lower base surface (63) is arranged on a lower end of the peripheral side wall (64) and extends essentially horizontally, and wherein the spacer (61) comprises centering spring elements (71); the centering spring elements are arranged on the inner side (70) of the longitudinal sides and transverse sides, each centering spring element (71) having a spring part (72) which is spaced apart from other centering spring elements (71) in relation to the inner side (70) of the respective longitudinal and traverse sides and each centering spring element extends between the lower base surface (63) and the upper surface (65); each spring part exerts a spring force between an inner sides (70) of a respective longitudinal or traverse side of the peripheral side wall (64) and a side wall of a pipette tip carrier, so that the spacer (61) centers a pipette tip carriers (62), onto which said spacer (61) is positioned, without locking the spacer (61) with said pipette tip carrier (62) the spacer is positioned on.

2. The spacer (61) according to claim 1, wherein the spacer (61) comprises connecting elements (67) on the upper surface (65) for providing a connection with the pipette tip carrier (62) which is positioned on the upper surface (65).

3. The spacer (61) according to claim 2, wherein the spacer (61) comprises four connecting elements (67), each connecting element (67) being a holding pin (67') arranged in a separate corner (68) of the upper surface (65), and standing vertically in relation to the upper surface (65).

4. The spacer (61) according to claim 3, wherein each holding pin (67') has a cross section (79) which is adapted to cross sections (79) of centering holes (78) of a pipette tip carrier (62) which is positioned on the upper surface of the spacer (61), for providing a friction fit connection with said pipette tip carrier (62), said cross section (79) of each holding pin (67') being selected from the group consisting of round, elliptical, oval, polygonal, and star-shaped cross section.

5. The spacer (61) according to claim 3, wherein each holding pin (67') tapers at an upper end (69) with increasing height.

6. The spacer (61) according to claim 1, wherein the spring part (72) of the centering spring elements (71) extend in a direction selected from the group consisting of vertically and horizontally.

7. The spacer (61) according to claim 1, wherein the spacer (61) is a one-piece, plastic component.

8. A method of stacking a plurality of pipette tip carriers (62) for use in a liquid handling workstation (93), comprising the steps of:

providing the plurality of pipette tip carriers (62), each pipette tip carrier comprising a plurality of pipette tips (84);

providing a plurality of spacers (61) according to the spacer of claim 1; and producing a stack of pipette tip carriers (62) comprising pipette tips (84) by alternatingly stacking a pipette tip carrier (62) from the plurality of pipette tip carriers (62) and a spacer (61) from the plurality of spacers (62) to form a plurality of pipette tip carrier-spacer combinations; wherein the stack includes at least one spacer (61) that spaces apart two of the pipette tip carriers (62).

9. The method according to claim 8, wherein each of the plurality of pipette tip carriers (62) comprises a flange (75) with four centering holes (78), each of the centering holes (78) being arranged on the flange (75) and having a defined cross section (77), wherein each of the plurality of spacers (61) comprises four holding pins (67'), each holding pin (67') being arranged on an upper surface (65), and standing vertically in relation to the upper surface (65), wherein each holding pin (67') of the plurality of spacers (61) has a cross section (79) which corresponds to the cross section (77) of the centering holes (78) of the plurality of pipette tip carriers (62), so that each holding pin (67') of a spacer (61) is fixedly insertable in one of the centering holes (78) of a pipette tip carrier (62) with friction fit, and wherein each spacer (61) of the plurality of spacers (61) holds one respective pipette tip carrier (62) of the plurality of pipette tip carriers (62) by insertion of the holding pins (67') of the spacer (61) with friction fit into the centering holes (78) of the respective pipette tip carrier (62) which is placed with its flange (75) on the upper surface (65) of the spacer (61) holding said respective pipette tip carrier (62).

10. The method according to claim 8, wherein each spacer (61) is laid with the lower base surface (63) on one of the plurality of pipette tip carriers (62).

11. The method according to claim 8, wherein each spacer (61) the stack of pipette tip carriers (62) is lifted off of an underlying pipette tip carrier (62) by a robot of a liquid handling workstation (93).

12. The method according to claim 9, wherein a spacer (61) of the stack of pipette tip carriers (62) is lifted off of an underlying pipette tip carrier (62) by a robot of a liquid handling workstation (93).

13. A pipette tip carrier-spacer assembly comprising:

a spacer (61) having an essentially rectangular cross-section; and a first pipette tip carrier having an essentially rectangular cross-section (62);

the spacer (61) comprising:

a lower base surface (63);

a peripheral side wall (64), which stands essentially perpendicular to the lower base surface (63) and forms a frame including two longitudinal sides and two transverse sides, wherein each longitudinal side and transverse side comprises an inner side (70);

an upper surface (65), adapted to receive thereon a second portion of onto which a pipette tip carrier (62) is positionable; and a central, essentially rectangular opening (73) in the upper surface (65) configured for receiving a part of a pipette tip carrier (62);

wherein the upper surface (65) is arranged on an upper end of the side wall (64) and extends essentially horizontally;

wherein the lower base surface (63) is arranged on a lower end of the peripheral side wall (64) and extends essentially horizontally;

wherein the spacer (61) comprises centering spring elements (71); the centering spring elements are arranged on the inner side (70) of the longitudinal sides and transverse sides, each centering spring element (71) having a spring part (72) which is spaced apart from other centering spring elements (71) in relation to the inner side (70) of the respective longitudinal and traverse sides and each centering spring element extends between the lower base surface (63) and the upper surface (65); each spring part exerts a spring force between an inner side (70) of a respective longitudinal or traverse side of the peripheral side wall (64) and a side wall of a pipette tip carrier, so that the spacer (61) centers a pipette tip carrier (62), onto which said spacer (61) is positioned, without locking the spacer (61) with said pipette tip carrier (62) the spacer is positioned on; and the first pipette tip carrier (62) comprising:

a plurality of pipette tips (84); and a flange;(75); and wherein the spacer (61) is inseparably connected via the upper surface (65) to said flange (75) of the first pipette tip carrier (62) which is positioned on the spacer (61).

14. The assembly according to claim 13, wherein the spring parts (72) of the centering spring elements (71) extend in a direction selected from the group consisting of vertically and horizontally.

15. The spacer (61) according to claim 13, wherein the spacer (61) and the first pipette tip carrier (62) are a one-piece, plastic component.

16. A method of positioning a plurality of pipette tip carriers (62) for use in a liquid handling workstation (93), comprising the steps of:

providing a plurality of pipette tip carrier-spacer assemblies of claim 13; and producing a stack of pipette tip carriers (62) comprising pipette tips (84) by stacking the plurality of pipette tip carrier-spacer assemblies on each other; wherein the stack of assemblies includes at least one spacer (61) that spaces apart two of the pipette tip carriers (62).

17. The method according to claim 16, further comprising lifting a pipette tip carrier-spacer assembly via the corresponding spacer (61) off of an underlying pipette tip carrier (62) by a robot of a liquid handling workstation (93).

* * * * *